US009476231B2

(12) United States Patent
Park et al.

(10) Patent No.: US 9,476,231 B2
(45) Date of Patent: Oct. 25, 2016

(54) POP UP DEVICE AND METHOD OF OPERATING AN OUTSIDE DOOR HANDLE

(71) Applicant: Hyundai Motor Company, Seoul (KR)

(72) Inventors: In Seong Park, Seoul (KR); Ho Taek Lee, Seoul (KR); Tae Yub Kim, Jinju-si (KR); Jong Yong Nam, Seongnam-si (KR); Yong Lee, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 308 days.

(21) Appl. No.: 13/903,919

(22) Filed: May 28, 2013

(65) Prior Publication Data

US 2014/0223975 A1 Aug. 14, 2014

(30) Foreign Application Priority Data

Feb. 8, 2013 (KR) ..... 10-2013-0014385

(51) Int. Cl.
*E05B 81/06* (2014.01)
*E05B 81/20* (2014.01)
*E05B 85/16* (2014.01)

(52) U.S. Cl.
CPC ..... *E05B 81/06* (2013.01); *E05B 81/20* (2013.01); *E05B 85/16* (2013.01); *Y10T 70/7073* (2015.04); *Y10T 292/1021* (2015.04); *Y10T 292/57* (2015.04)

(58) Field of Classification Search
CPC ..... E05B 81/06; E05B 81/20; E05B 85/16
USPC ..... 292/336.3, 144, 201
See application file for complete search history.

(56) References Cited

U.S. PATENT DOCUMENTS

| | | | | |
|---|---|---|---|---|
| 8,403,376 | B2 * | 3/2013 | Greiner | E05B 47/0012 292/144 |
| 2009/0273195 | A1 * | 11/2009 | Forrester | 292/336.3 |
| 2010/0244466 | A1 * | 9/2010 | Tomaszewski | E05B 77/26 292/201 |
| 2011/0148575 | A1 * | 6/2011 | Sobecki et al. | 340/5.64 |
| 2014/0132012 | A1 * | 5/2014 | Yoshino | E05B 85/103 292/336.3 |

FOREIGN PATENT DOCUMENTS

| | | | |
|---|---|---|---|
| JP | 2004-239008 | A | 8/2004 |
| KR | 10-2003-0060582 | A | 7/2003 |
| KR | 2007-0012908 | A | 1/2007 |
| KR | 10-0756639 | B1 | 9/2007 |
| KR | 10-2008-0036824 | A | 4/2008 |
| KR | 10-0862255 | B1 | 10/2008 |
| KR | 10-0867741 | B1 | 11/2008 |
| KR | 2011-0052394 | A | 5/2011 |

* cited by examiner

*Primary Examiner* — Kristina Fulton
*Assistant Examiner* — Thomas Neubauer
(74) *Attorney, Agent, or Firm* — McDermott Will & Emery LLP

(57) ABSTRACT

A pop up device of an outside door handle includes a motor part interlocking with a smart key and receiving a signal from the smart key to thereby be operated; a cam part connected to the motor part to be rotatable in a horizontal direction; and a grip handle body having one end provided at an outer side of a door of a vehicle and another end provided at a cam part side to thereby be mounted at a grip handle base on a door side so as to be popped up. Therefore, the grip handle body is popped up to improve convenience in operating the outside door handle when a passenger gets in the vehicle and to prevent damage to the vehicle and injury to a hand of the passenger, thereby making it possible to improve salability and stability.

5 Claims, 10 Drawing Sheets

POP UP DEVICE AND METHOD OF OPERATING AN OUTSIDE DOOR HANDLE

CROSS-REFERENCE TO RELATED APPLICATION

This application is based on and claims priority from Korean Patent Application No. 10-2013-0014385, filed on Feb. 8, 2013 in the Korean Intellectual Property Office, the disclosure of which is incorporated herein in its entirety by reference.

BACKGROUND OF THE DISCLOSURE

1. Field of the Disclosure

The present disclosure relates to a pop up device and method of operating an outside door handle, and more particularly, to a pop up device and method of operating an outside door handle for minimizing interference generated between a passenger's hand and a door panel at the time of opening a door.

2. Description of the Related Art

Generally, in a welcome function of a vehicle, when a driver possessing a smart key approaches the vehicle, the smart key receiving a low frequency (LF) signal radiated from an LF antenna of the vehicle transmits a radio frequency (RF) signal, a smart key controller performs authentication for the RF signal, and lighting of a lamp, movement of an outside mirror, a welcome sound operation, and the like, are performed in the case in which the smart key is valid.

The welcome system serves to facilitate recognition by the vehicle of the user or satisfy an emotional desire. However, the welcome system does not actually help the driver to get in or out of the vehicle.

In addition, according to the related art, when a passenger uses an outside door handle, a scratch occurs in a door panel due to a ring worn by the passenger or a long finger nail contacting a door in a process in which a woman driver having the long finger nail puts her hand in a grip handle, such that damage occurs, thereby deteriorating salability and stability.

SUMMARY OF THE DISCLOSURE

Accordingly, the present disclosure has been made to solve the above-mentioned problems occurring in the related art while advantages achieved by the related art are maintained intact.

One object to be achieved by the present disclosure is to provide a pop up device and method of operating an outside door handle for minimizing interference generated between a passenger's hand and a door panel at the time of opening a door.

In one aspect of the present disclosure, there is provided a pop up device of an outside door handle, including: a motor part interlocking with a smart key and receiving a signal from the smart key to thereby be operated; a cam part connected to the motor part to be rotatable in a horizontal direction; and a grip handle body having one end provided at an outer side of a door of a vehicle and another end provided at a cam part side to thereby be mounted at a grip handle base on a door side so as to be popped up.

The pop up device of an outside door handle may further include a grip handle return lever having one end connected to the grip handle base and another end connected to the grip handle body to return the grip handle body to an original position after the door is opened.

The one end of the grip handle return lever may be connected to the grip handle base through a spring.

The motor part may include: a step motor generating a rotational force when receiving the signal from the smart key; and a first bevel gear connected to the step motor and protruding outwardly.

The cam part may include: a second bevel gear engaged with the first bevel gear; and a cam plate connected to the second bevel gear to thereby be rotatable.

In another aspect of the present disclosure, there is provided a pop up method of operating an outside door handle, including: a first judging step of judging whether or not a smart key has approached a grip handle body within a predetermined distance in a state in which the smart key and the grip handle body interlock with each other; a first operating step of popping up the grip handle body outwardly if it is judged in the first judging step that the smart key has approached the grip handle body within the predetermined distance; a second judging step of judging whether or not a door of a vehicle has been opened after the grip handle body is popped up in the first operating step; and a second operating step of returning the grip handle body to an original position if it is judged in the second judging step that the door of the vehicle has been opened.

BRIEF DESCRIPTION OF THE DRAWINGS

The above and other objects, features and advantages of the present disclosure will be more apparent from the following detailed description taken in conjunction with the accompanying drawings, in which.

DETAILED DESCRIPTION OF THE PREFERRED EMBODIMENTS

Exemplary embodiments of the present disclosure will be described in detail with reference to the accompanying drawings.

A pop up device of an outside door handle according to an exemplary embodiment of the present disclosure is configured to include a motor part 100 interlocking with a smart key, a cam part 200 connected to the motor part 100 to thereby rotate, and a grip handle body 300 connected to the cam part 200 and provided so as to be popped up from a door side, as shown in FIGS. 1 to 9D.

Figure 1:
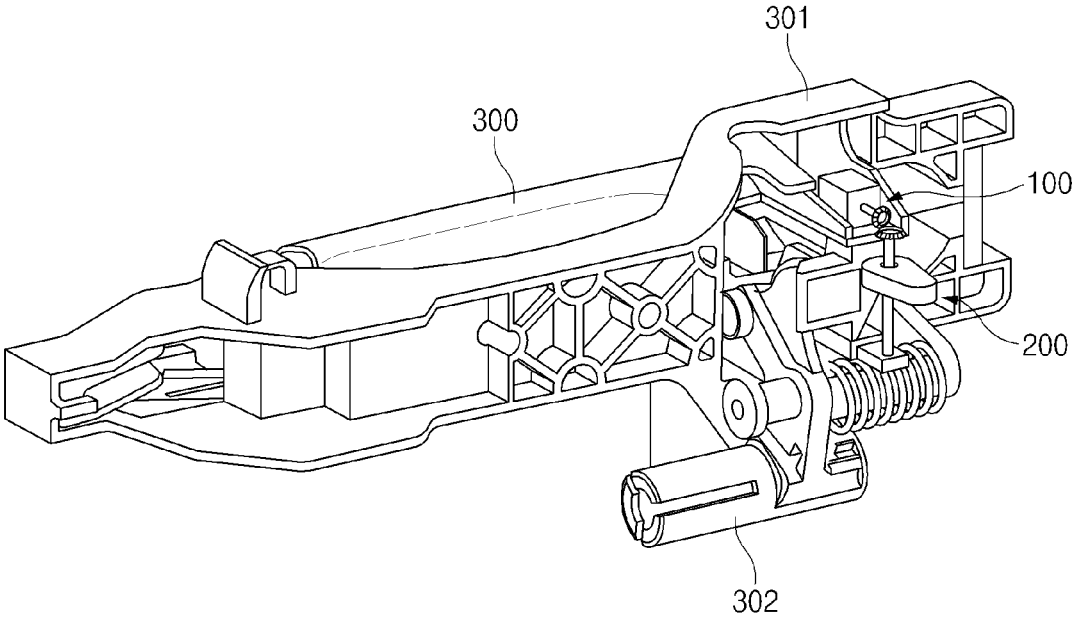
FIG. 1 is a view showing a pop up device of an outside door handle according to an exemplary embodiment of the present disclosure.
Figure 2:
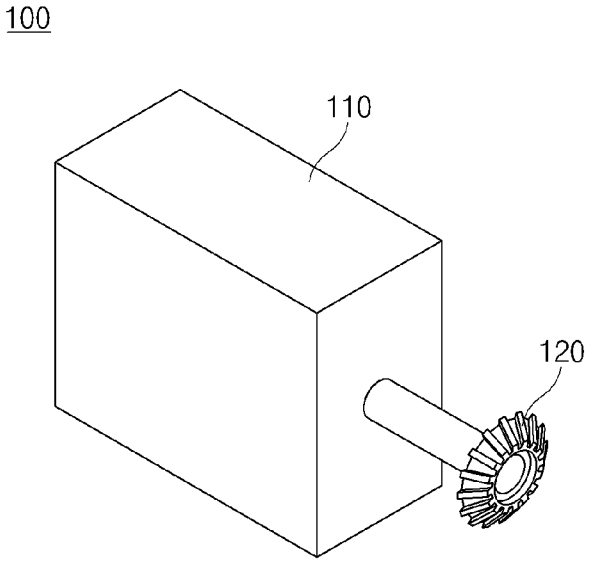
FIG. 2 is a view showing a motor part in the pop up device of an outside door handle according to the exemplary embodiment of the present disclosure.
Figure 3:
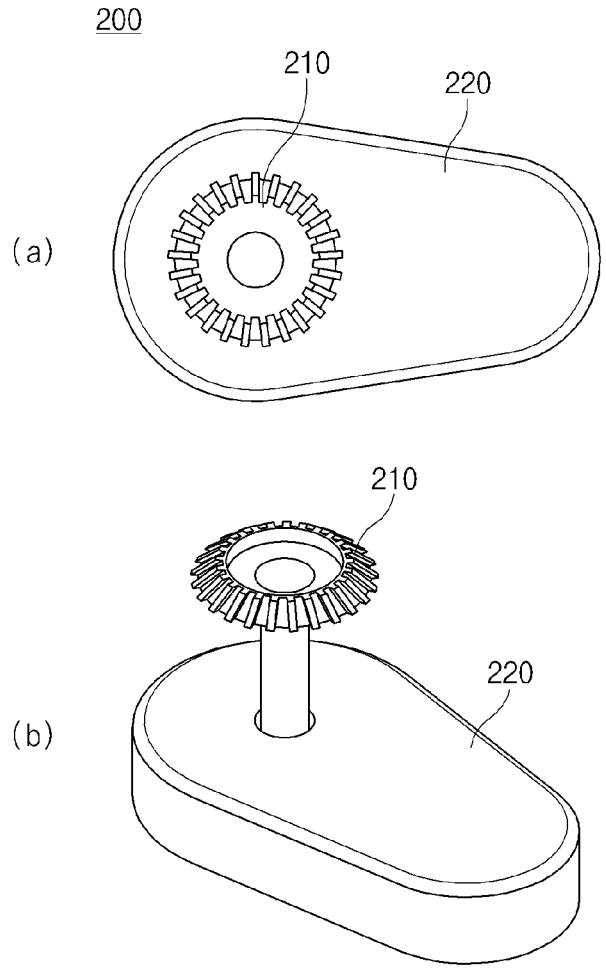
FIGS. 3A and 3B are views showing a cam part in the pop up device of an outside door handle according to the exemplary embodiment of the present disclosure.

As shown in FIGS. 1 and 2, the motor part 100, which enables a rotational operation through a motor, interlocks with the smart key for a vehicle and receives a signal associated with a door from the smart key to thereby be operated.

Here, the motor part 100 includes a step motor 110 capable of generating rotational force at the time of receiving the signal from the smart key and a first bevel gear 120 connected to the step motor 110 and protruding outwardly for transferring the rotational force.

As shown in FIGS. 1, 3A and 3B, the cam part 200 is connected to the motor part 100 to thereby be rotatable in a horizontal direction.

The cam part 200 includes a second bevel gear 210 vertically coupled to the first bevel gear 120 of the motor part 100 and a cam plate 220 interlocking with the second bevel gear 210 to thereby be rotatable. Therefore, when the motor part 100 starts operating when receiving the signal from the smart key, the cam plate 220 of the cam part 200 is rotated to push or pull a grip handle base 301 to be described below.

Figure 4:
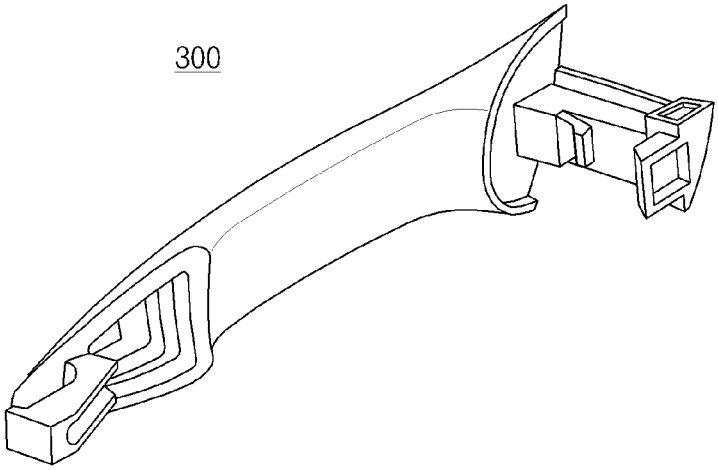
FIG. 4 is a view showing a grip handle body in the pop up device of an outside door handle according to the exemplary embodiment of the present disclosure.

As shown in FIGS. 1 and 4, the grip handle body 300 is mounted at the grip handle base 301 on the door side so as to be popped up. The grip handle base 301 has one end provided at an outer side of the door of the vehicle and another end provided at a cam part 200 side to allow the grip handle body 300 to be pushed or pulled by an operation of the cam part 200.

Figure 5:
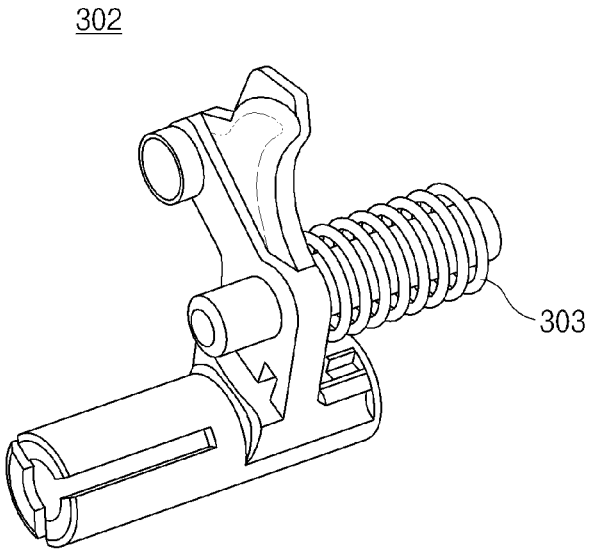
FIG. 5 is a view showing a grip handle return lever in the pop up device of an outside door handle according to the exemplary embodiment of the present disclosure.

As shown in FIGS. 1 and 5, a grip handle return lever 302 is provided in order to return the grip handle body 300 to its original position after the grip handle body 300 is popped up. Here, it is preferable that the grip handle return lever 302 has one end connected to the grip handle base 301 and another end connected to the grip handle body 300 to return the grip handle body 300 to its original position after the door is opened.

One end of the grip handle return lever 302 is provided with a spring 303, thereby making it possible to improve a return force applied to the grip handle body 300.

An operation of the pop up device of an outside door handle according to an exemplary embodiment of the present disclosure will be described below.

Figure 6:
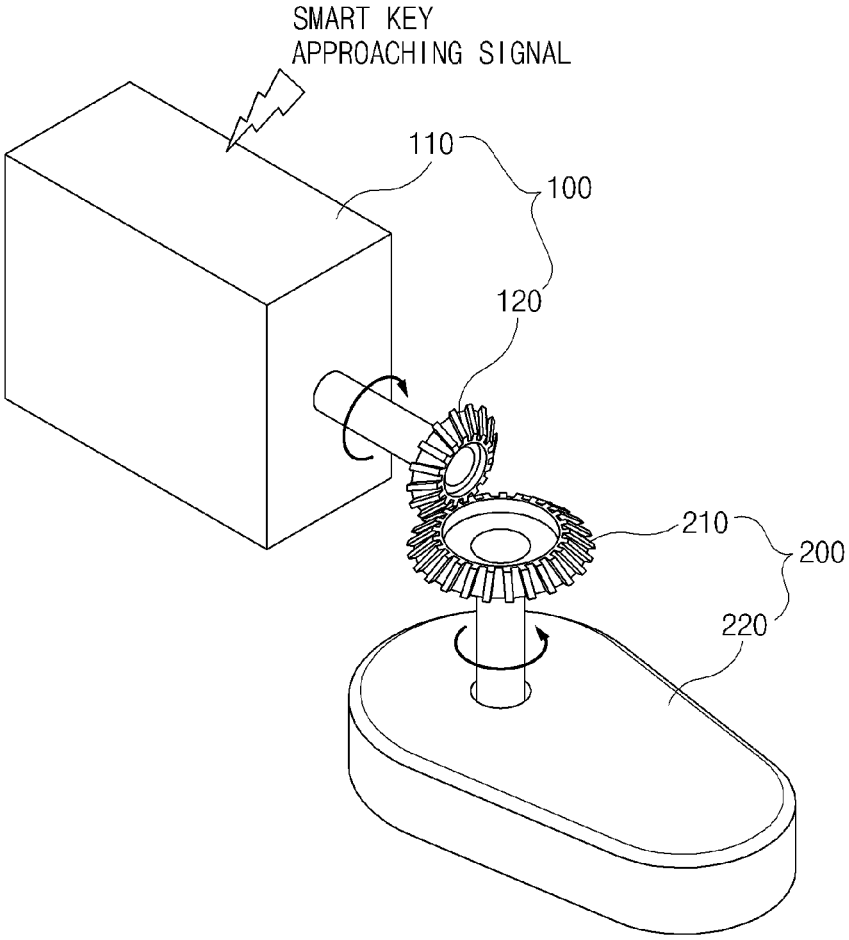
FIG. 6 is a view showing a rotation direction of a cam plate at the time of pop up in the pop up device of an outside door handle according to the exemplary embodiment of the present disclosure.

First, when a driver possessing the smart key approaches the grip handle body 300, a signal of the smart key is transmitted to the motor part 100 to operate the step motor 110, as shown in FIG. 6.

Figure 8:
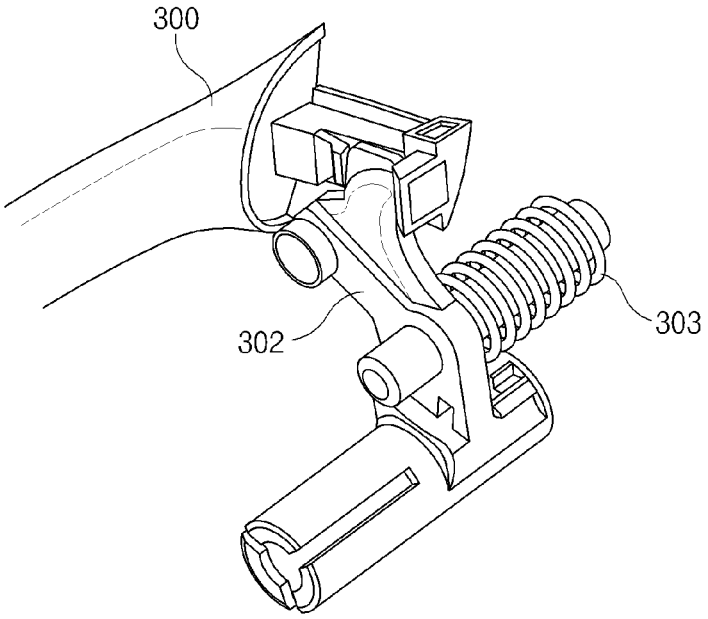
FIG. 8 is a view showing a pop up direction of the grip handle body in the pop up device of an outside door handle according to the exemplary embodiment of the present disclosure.
Figure 9:
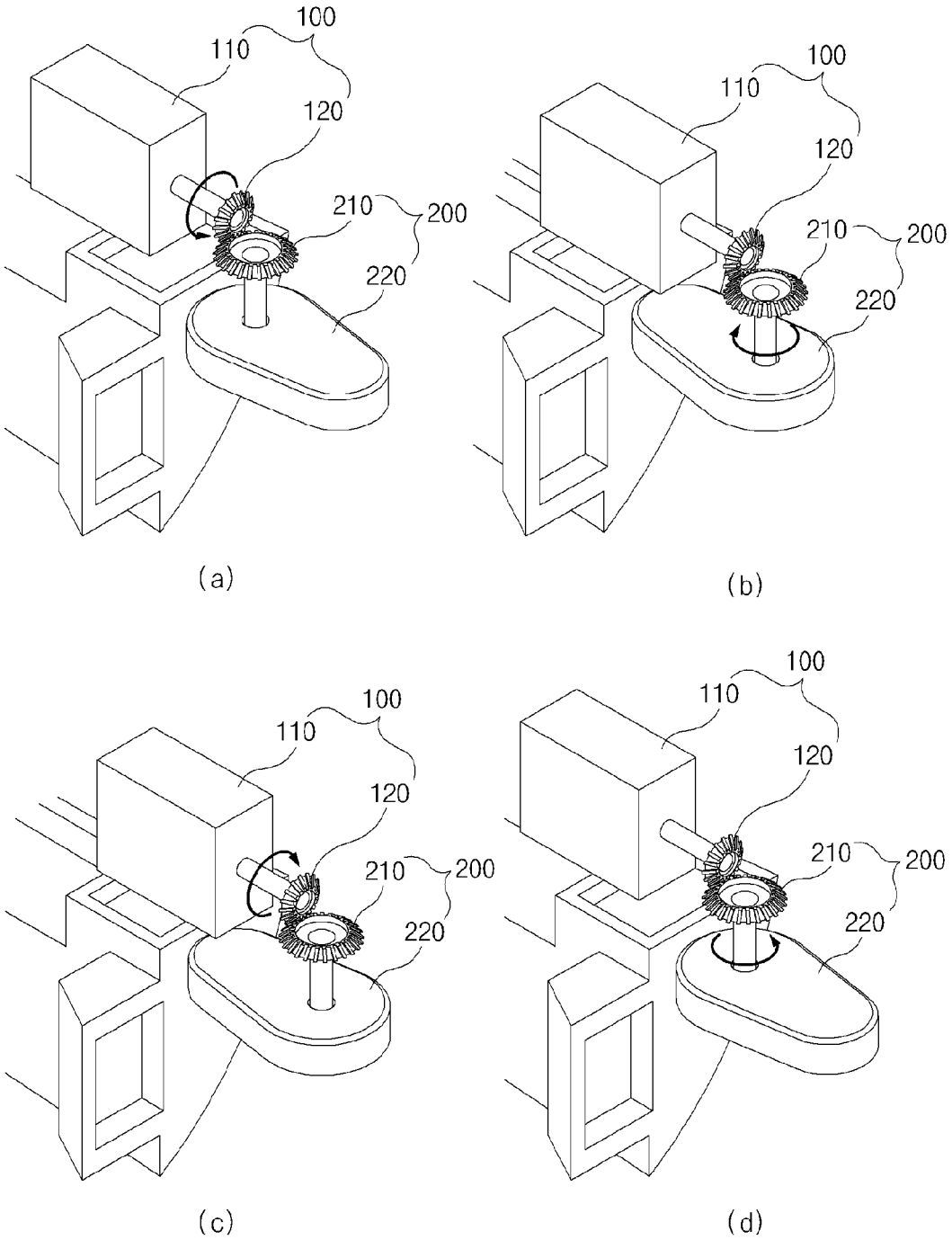
FIGS. 9A to 9D are views showing an operation process of the pop up device of an outside door handle according to the exemplary embodiment of the present disclosure.

As shown in FIGS. 6 and 8, when the step motor 110 is rotated, the first bevel gear 120 is rotated. The rotation of the first bevel gear 120 is transferred to the second bevel gear 210 of the cam part 200 engaged with the first bevel gear 120, such that the cam plate 220 connected to the second bevel gear 210 is rotated to push the grip handle body 300.

Here, it is preferable that the cam plate 220 is set to be rotated 180 degrees and a pop up amount of the grip handle body 300 is set to be 10 mm. Distances (e.g., 10 mm) from the second bevel gear 210 to both sides of the cam plate 220 are designed to be different from each other, such that when a short side of the cam plate 220 and the grip handle body 300 correspond to each other at the time of rotation of the second bevel gear 210, the grip handle body 300 is not popped up, and when a long side of the cam plate 220 and the grip handle body 300 correspond to each other at the time of rotation of the second bevel gear 210, the grip handle body 300 is pushed to thereby be naturally popped up, as shown in FIGS. 3A, 3B, 9A and 9B.

Figure 7:
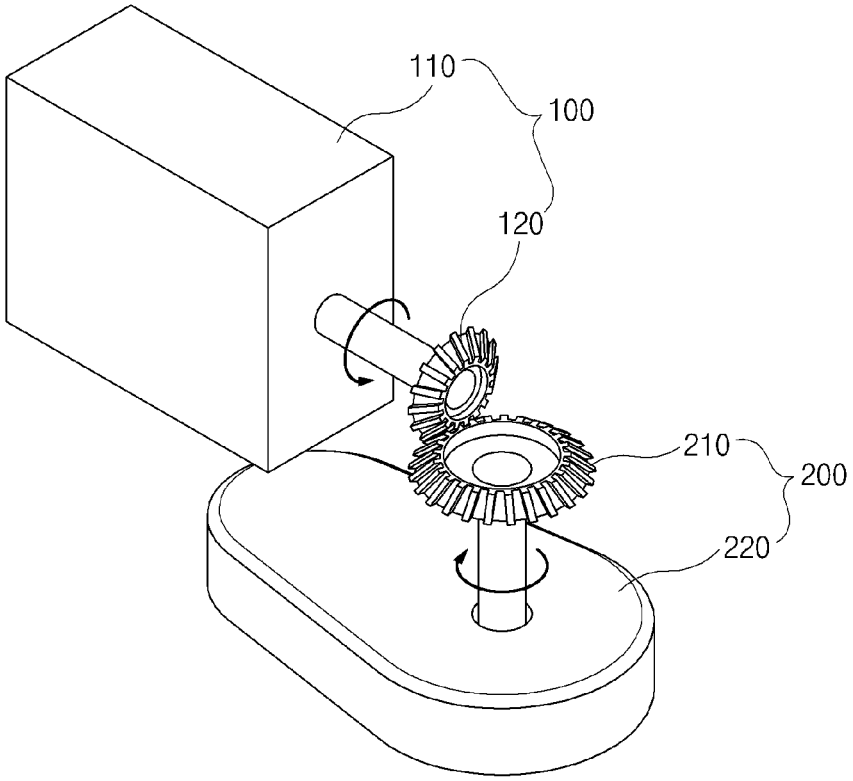
FIG. 7 is a view showing a rotation direction of the cam plate at the time of return in the pop up device of an outside door handle according to the exemplary embodiment of the present disclosure.

When the driver gets in the vehicle while maintaining the pop up state of the grip handle body 300 and then closes the door, as shown in FIGS. 7, 9C, and 9D, a door closing signal is transferred to the smart key through a door opening/closing sensor, and is then transmitted to the motor part 100 to allow the step motor 110 to be rotated in a direction opposite to the direction in which the step motor 110 is rotated at the time of popping up the grip handle body 300, such that the first bevel gear 120, the second bevel gear 210, and the cam plate 220 are also rotated in the opposite direction, thereby returning the grip handle body 300 to its original position.

Figure 10:
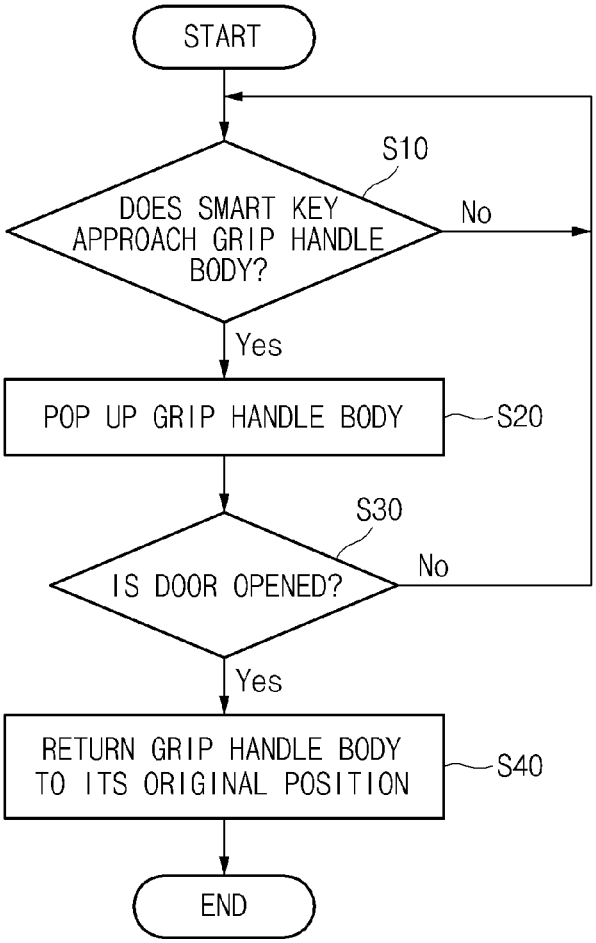
FIG. 10 is a flow chart showing a pop up method of operating an outside door handle according to the exemplary embodiment of the present disclosure.

A pop up method for an outside door handle according to the exemplary embodiment of the present disclosure includes a first judging step (S10) of judging whether or not the smart key has approached the handle grip body 300, a first operating step (S20) of popping up the grip handle body 300, a second judging step (S30) of judging whether or not the door has been opened, and a second operating step (S40) of returning the grip handle body 300 to its original position, as shown in FIG. 10.

In the first judging step (S10), it is judged whether or not the driver possessing the smart key has approached the grip handle body 300 within a predetermined distance in a state in which the smart key and the grip handle body 300 interlock with each other.

At this time, if it is judged that the driver possessing the smart key has approached the grip handle body 300, the pop up method of operating an outside door handle according to the exemplary embodiment of the present disclosure moves to the first operating step (S20), and if it is not judged that the driver possessing the smart key has approached the grip handle body 300, the pop up method of operating an outside door handle according to the exemplary embodiment of the present disclosure moves to an initial logic.

In the first operating step (S20), the grip handle body 300 is popped up outwardly of the door by a predetermined interval, thereby improving the convenience in operating the grip handle body 300 at the time of opening the door and preventing damage to the vehicle and injury to a hand of the passenger.

In the second judging step (S30), which is a step of judging whether or not the door of the vehicle has been opened after the grip handle body 300 is popped up in the first operating step (S20), if it is judged that the door has been opened, the pop up method of operating an outside door handle according to the exemplary embodiment of the present disclosure moves to the second operating step (S40); and if it is judged that the door has not been opened, it is determined that the passenger does not intend to get in the vehicle, so that the pop up method of operating an outside door handle according to the exemplary embodiment of the present disclosure moves to the initial logic.

In the second operating step (S40), if it is judged in the second judging step (S30) that the door has been opened, the grip handle body 300 is returned to its original position.

As set forth above, according to the exemplary embodiment of the present disclosure, the grip handle body is popped up to improve convenience in operating the outside door handle when the passenger gets in the vehicle and to prevent damage to the vehicle and injury to the hand of the passenger, thereby making it possible to improve salability and stability.

As described above, although the present disclosure has been described with reference to exemplary embodiments and the accompanying drawings, it would be appreciated by those having ordinary skill in the art that the present disclosure is not limited thereto but various modifications and alterations might be made without departing from the scope defined in the following claims.

What is claimed is:

1. A pop up device of an outside door handle, comprising:

a motor part receiving a signal from a smart key to thereby be operated;

a cam part connected to the motor part to be rotatable;

a grip handle body having one end provided at an outer side of a door of a vehicle and another end provided at the cam part side to thereby be mounted at a grip handle base on a door side; and a grip handle return lever having one end connected to the grip handle base and another end connected to the grip handle body to return the grip handle body to an original position after the door is opened, wherein a shaft of the motor part and a shaft of the cam part are perpendicular to each other.

2. The pop up device of an outside door handle according to claim 1, wherein the one end of the grip handle return lever is connected to the grip handle base through a spring.

3. The pop up device of an outside door handle according to claim 1, wherein the motor part includes:

a step motor generating a rotational force when receiving the signal from the smart key; and a first bevel gear connected to the step motor and protruding outwardly.

4. The pop up device of an outside door handle according to claim 1, wherein the cam part includes:

a second bevel gear engaged with a first bevel gear of the motor part; and a cam plate connected to the second bevel gear to thereby be rotatable.

5. The pop up device of an outside door handle according to claim 1, wherein the cam part rotates in a horizontal direction.

* * * * *